United States Patent [19]

Desautels et al.

[11] Patent Number: 4,940,076

[45] Date of Patent: Jul. 10, 1990

[54] METHOD AND APPARATUS FOR STEERING CASTING BELTS OF CONTINUOUS METAL-CASTING MACHINES

[75] Inventors: S. Jerry Desautels; Timothy D. Kaiser, both of Colchester, Vt.

[73] Assignee: Hazelett Strip-Casting Corporation, Colchester, Vt.

[21] Appl. No.: 348,976

[22] Filed: May 9, 1989

[51] Int. Cl.[5] ..... B22D 11/06

[52] U.S. Cl. ..... 164/452; 164/432; 164/429; 164/154; 164/481

[58] Field of Search ..... 164/451, 452, 481, 479, 164/154, 427, 429, 431, 432

[56] References Cited

U.S. PATENT DOCUMENTS 3,123,874 3/1964 Hazelett ..... 164/154

FOREIGN PATENT DOCUMENTS 65-1153 10/1962 Canada ..... 164/431
63-049355 3/1988 Japan ..... 164/154
63-101054 5/1988 Japan ..... 164/431

*Primary Examiner*—Richard K. Seidel
*Assistant Examiner*—Rex E. Pelto
*Attorney, Agent, or Firm*—Parmelee, Bollinger & Bramblett

[57] ABSTRACT

A method and system is used for achieving increased precision of steering of the flexible, metallic endless belts of continuous metal-casting machines. Such belts usually have the imperfections inherent in the parent strip metal from which the belt is made. For example, in low-carbon steel, there is generally a "camber," a curvature of the edges in the plane of the strip material. Belts, revolving in the machine, are normally steered through sensing the lateral position of one edge. If the edge is not true, due to camber, the servo steering system of the prior art will continually "hunt" caused by variations in lateral position of the cambered edge. The present invention provides a steering method and system responsive to a single signal source, fixed on a belt edge. This single signal source is achieved by notching or otherwise cuing a belt at one place along an edge so that the steering sensor senses this cue notch as the belt revolves. A first electrical circuit senses this cue notch and activates or initiates, i.e. cues the commencement of a sensing control operation. The sensing control operation, in response to sensing of a tracking error of a predetermined control place or region on the belt following the "cue", then governs the steering mechanism and thereby eliminates or substantially reduces the prior art continual "hunting" steering problems in twin-belt metal casting machines.

19 Claims, 4 Drawing Sheets

4
4
U
P
L
27
12
12
12
12
C
8
27
10
10
E
8
9

METHOD AND APPARATUS FOR STEERING CASTING BELTS OF CONTINUOUS METAL-CASTING MACHINES

TECHNICAL FIELD

The present invention relates to the steering of long, flexible, thin endless metallic belts that revolve around pulleys of belt-type continuous metal-casting machines and which constitute at least part of the moving mold of such casting machines.

BACKGROUND

An endless revolving flexible metallic belt employed in the continuous casting of metals should run true. Ideally, the centerline of the belt should be juxtaposed on, and precisely revolve around, the peripheral centerlines of the fixed point or pulleys around which it is oriented. In practice, however, metallic belts usually have an imperfection, namely "camber," i.e., a side-to-side (lateral) variation or deviation of the edge from a straight or true line caused by imperfections in the parent metal strip from which the belt is made. Consequently, the edges of these belts usually do not run true, even though flat, but have side-to-side curvature deviations in the plane of the belt, due to problems in metal strip production at the strip mill in casting and rolling of the raw strip material from which the belt is made. Belts in a twin-belt casting machine are normally steered by continually sensing the lateral or side-to-side position of one edge of the revolving belt while the edge passes a stationary sensor. The edge passes completely by the sensor during every revolution of the belt, and the continually-sensing sensor is ready to send out corrective steering signals at any time.

Since the edge is not true, a prior-art steering system will inevitably "hunt" back and forth in response to the variations or deviations of the endlessly passing cambered edge. In other words, a prior-art sensing and steering system is continually endeavoring (or straining) to keep the cambered-edge belt on centerline. This prior-art continual "hunting" sensing and steering results in needless wear of the steering mechanism. More important, the relatively wide sideways excursions of the steered belt result in worn streaks in the belt coating adjacent to the edge dams, upsetting the proper heat transfer pattern. The sideways excursions of the belt further impart diagonal flutes and variable tension of the belt in the moving mold, which, in combination with thermal stresses, may result in loss of contact with the freezing slab being cast, thus causing disturbance to the slab. Since the belts are the dominant moving mold surface, such disturbance is detrimental to metallurgical quality of the slab being cast.

This deteriment to the slab being cast is especially true when the method of steering is transverse tilting of a pulley. Such transverse-pulley-tilt steering method is described in various configurations in U.S. Pat. Nos. 3,123,874, 3,142,873, 3,167,830, 3,228,072, 3,310,849, 3,878,883, and 3,963,068. These patents all apply to twin-belt continuous casting machines, in which the downstream or exit pulleys are normally tilted to steer the belts, the tilting being in a plane perpendicular to the straight reaches of the belts. With the hunting type of control used in the prior art, the tilting-pulley-steering method would tilt a pulley through a range of perhaps as much as 0.100 of an inch (2.5 mm) at the exit-pulley end of the casting machine. When this tilt happens rapidly, the thin, flexible, revolving belt is forced into readjustment by sliding across the face of the pulley. The friction of this sliding under the normal range of belt tension results in ripples or "flutes" extending in the belt in the direction of the tension. A further result of such pulley tilting inherent in the prior art of hunt-type sensing and steering is the need to space or offset the downstream (steering) pulleys away from the emerging frozen product by the maximum amount of permitted tilt in order to provide clearance so that the tilting pulleys will not intrude into the "pass line" along which the cast product is moving. To make such clearance available, the moving belt must depart from the pass line at the last backup roller, changing direction there to be tangent to the tiltable exit pulley. The result of such belt departure was that the emerging product necessarily lost the benefit of an extra length of belt contact. This lost benefit is not just a question of causing a bit of reduction of casting machine speed and hence of reduced production per unit time; more importantly, such loss of the benefit of belt contact is also a matter of creating an uncontrolled zone near the exit wherein bulging or swelling of the freezing product can occur if the emerging product has a substantial liquid center immediately prior to and during emergence from the moving mold. It is especially to be noted that a substantial liquid center in the emerging product is desirable in the twin-belt casting of steel in view of its low thermal conductivity.

A partial solution to this transverse-pulley-steering problem is lateral or coplanar skew steering. Coplanar-skew steering method and apparatus are described in U.S. Pat. No. 4,901,785, owned in part by the assignee of the present application. With coplanar-skew steering, there is no need to offset the exit or steering pulleys away from the pass line, and hence there is no loss of contact of the belts with the freezing product. But, in attempting to employ coplanar-skew steering in combination with the above-described prior-art continual "hunting"-sensing and steering of belt lateral position, the resulting excursions of the belt can result in undesirable differential tension—i.e., one edge of the belt can have more tension than the other.

A visually observable problem caused by the prior-art continual "hunting"-sensing and steering control is wear of insulative belt coatings near the edge dams 8 (FIG. 1). Edge dams, whether moving or stationary, generally are constrained never to move sideways, whereas the steered belts have freedom to do so because they cannot be forcibly constrained without destroying them. The side-to-side steering excursions of the belts revolving relative to the laterally constrained edge dams have caused belt coatings to be worn, rubbed or scrubbed away by the edge dams, thus exposing areas of the belt that are subsequently exposed to molten metal when the belt is steered back the other way in the continual hunting action of the prior art. Exposed, worn areas of reduced or missing belt coatings as wide as $\frac{3}{8}$ of an inch (9 mm) have been reported in the prior art. This exposure of uncoated areas resultes in accelerated freezing of the cast metallic product at the worn places so exposed, with undesirable effects on the product as discussed in U.S. Pat. No. 4,545,423—"Refractory Coating of Edge-Dam Blocks for the Purpose of Preventing Longitudinal Bands of Sinkage."

SUMMARY OF THE DISCLOSURE

The present invention eliminates or substantially reduces the problems discussed above by providing a method and system of steering control that responds only to signals from one point or one short length along the edge of the revolving belt. In accordance with the invention, each belt is notched or otherwise cued fixedly at one place along or near an edge so that a steering sensor senses this notch or cue as the belt revolves. A first (cueing) electrical circuit, fed from the sensor, recognizes this cue notch as a unique place and accordingly activates a second circuit—an electrical-processing steering-control circuit that is set up to send out steering-control instructions in response to the side-to-side lateral tracking error of the belt as a whole.

In order to reflect only the sideways tracking error of the belt as a whole (in contradistinction to the lateral tracking errors of the cambered edge of the belt), the steering control circuit only sends these steering signals to indicate the position of some one predetermined place or region on the belt following the sensing of a cue. This predetermined place on the belt is called the "tracking-error-sensing region" and is conveniently arranged to pass the sensor station at a time immediately or soon following the passage of the cue notch past the sensor. The second or electrical control circuit, after being cued, then issues commands (based upon sensed tracking errors) to the mechanical steering apparatus to take corrective steering action.

In the preferred mode of employing the present invention, the sensor does not send merely a "yes-no" signal but sends a signal that is substantially proportional to the sensed lateral tracking error of the predetermined tracking-error-sensing region on the revolving belt edge, following sensing of the cue. The sensing may occur at a multiplicity of closely spaced points within the predetermined tracking-error-sensing region, with extreme readings being discarded, in order to obtain a reliably consistent signal.

BRIEF DESCRIPTION OF THE DRAWINGS

The invention, together with further aspects, objects, features and advantages thereof will be more clearly understood from a consideration of the following description taken in connection with the accompanying drawings which are arranged for clarity of illustration and not necessarily to scale, and in which like reference numerals are used to refer to corresponding elements throughout the various views.

FIG. 1 is a view looking toward the outboard side of the machine, namely, looking in the direction indicated by the dashed line and arrow I in FIG. 4.

FIG. 4 is a view as seen looking generally in the direction IV—IV in FIG. 1.

DETAILED DESCRIPTION OF PREFERRED EMBODIMENTS

Figure 1:
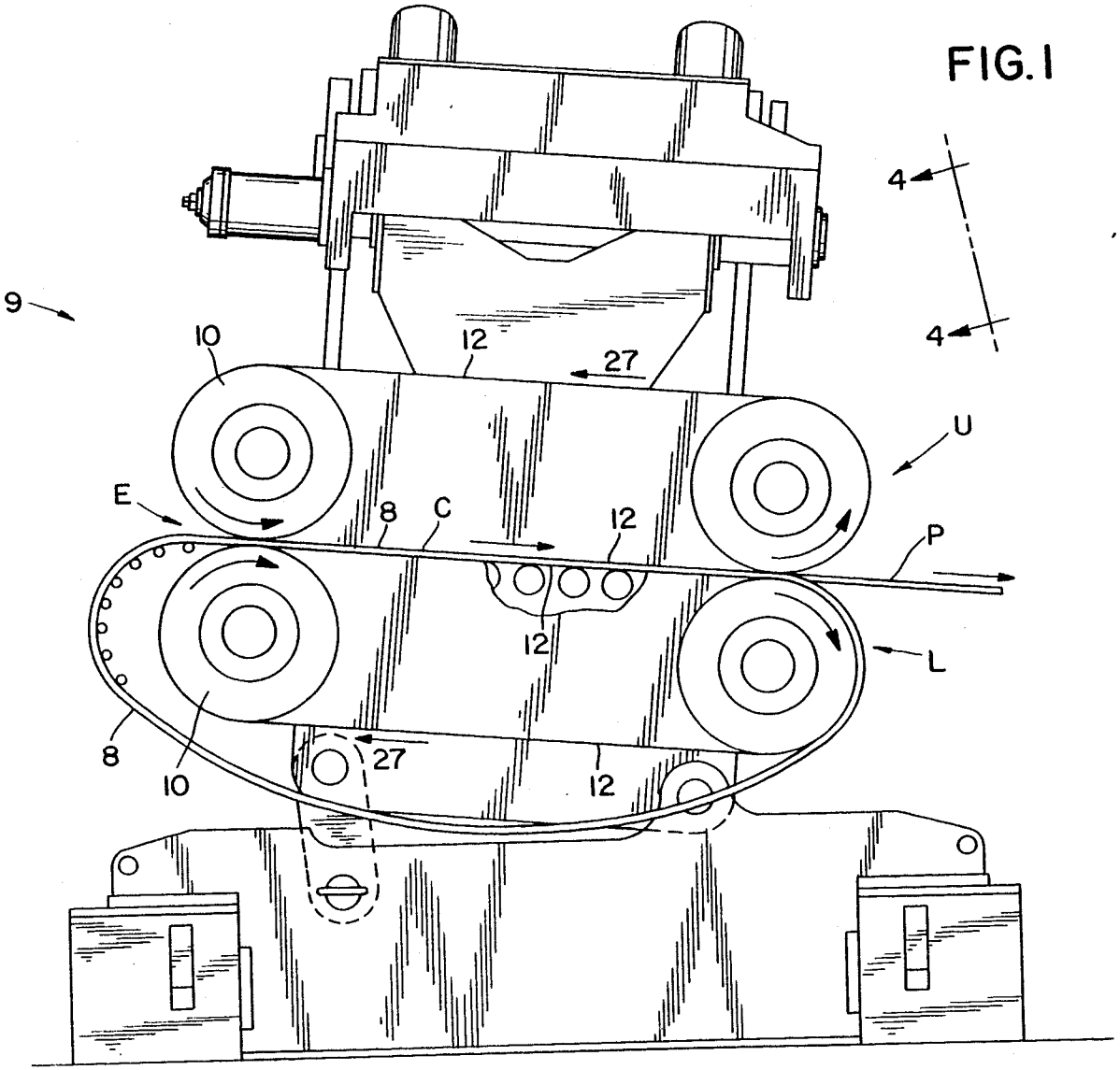
FIG. 1 is a side elevational view of a twin-belt continuous metal-casting machine incorporating the present invention.

The invention will be illustrated in the context of a twin-belt continuous metal-casting machine using rotating pulleys 10 as shown in FIG. 1, through the invention can be applied to any continuous metal-casting machine employing a flexible, wide, endless moving casting belt. E indicates the entrance for molten metal being fed into the machine. C the casting cavity, U the upper carriage, L the lower carriage, and P the emerging cast metallic product. The invention is described in terms for example of a cue notch in the edge of a belt serving as a fixed cue signal source for initiating the steering sequence, though other kinds of cue signal source fixed to the belt are possible, for example a small elongated oval hole near the edge for optical or mechanical sensing.

Figure 2:
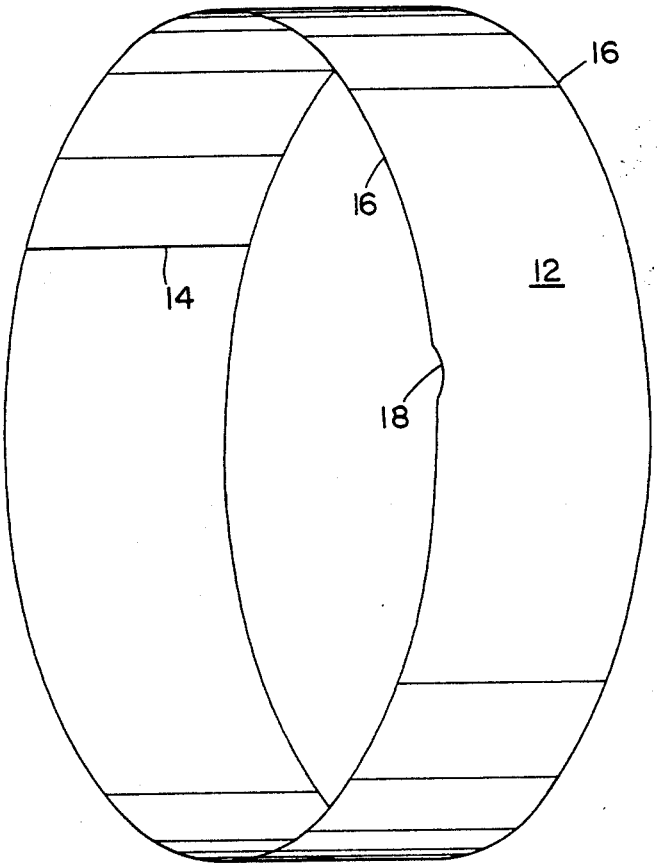
FIG. 2 is a perspective view showing a casting belt made from sheet-metal stock and embodying a fixed cue signal source in accord with the invention. For example, this cue signal source is a notch formed in the belt edge.
Figure 3:
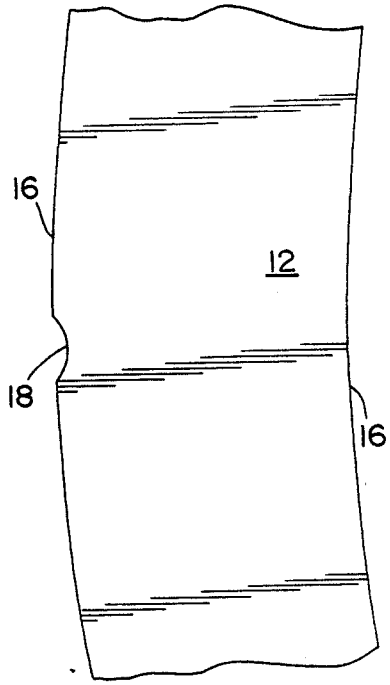
FIG. 3 shows part of the casting belt of FIG. 2 in flattened plan view for revealing the "camber," here shown exaggerated.
Figure 4:
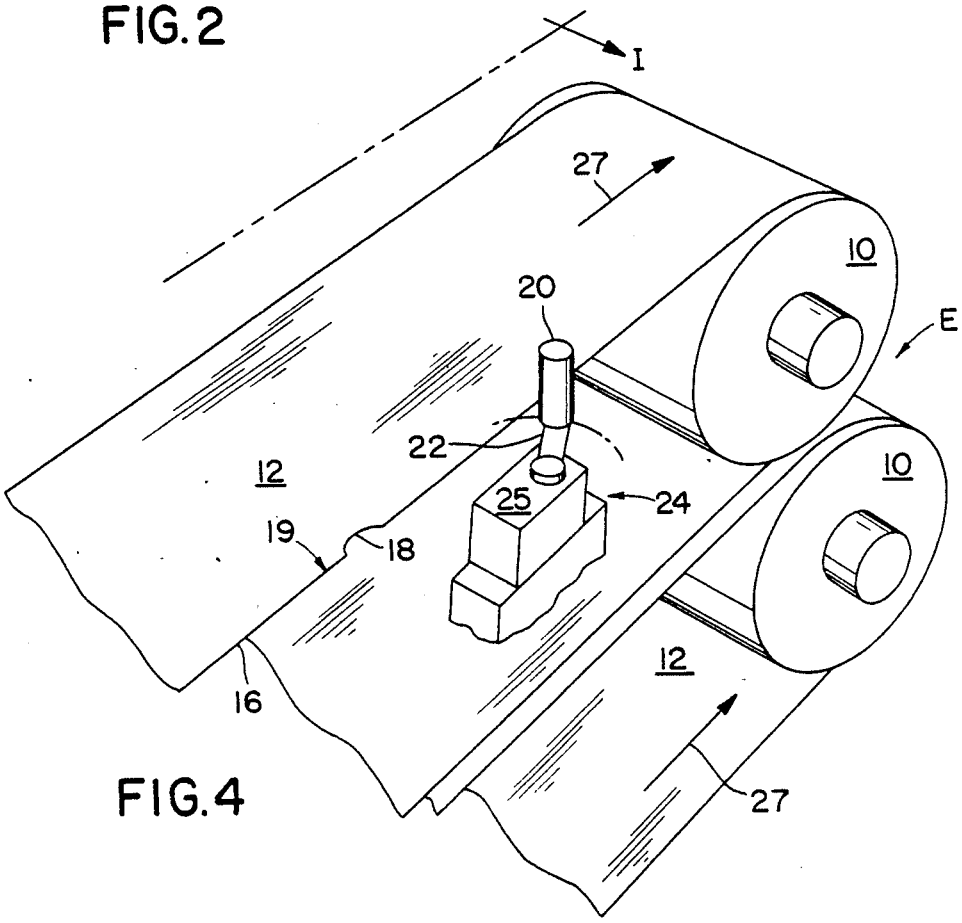
FIG. 4 is a perspective view of sensing means mounted near the edge of an upper casting belt in a twin-belt metal casting machine, such as shown in FIG. 1. Framing and bearings have been omitted from FIG. 4 for clarity of illustration. It is noted that the sensing means are shown mounted near the entrance end "E" (also called the upstream end) of the casting machine.
Figure 5:
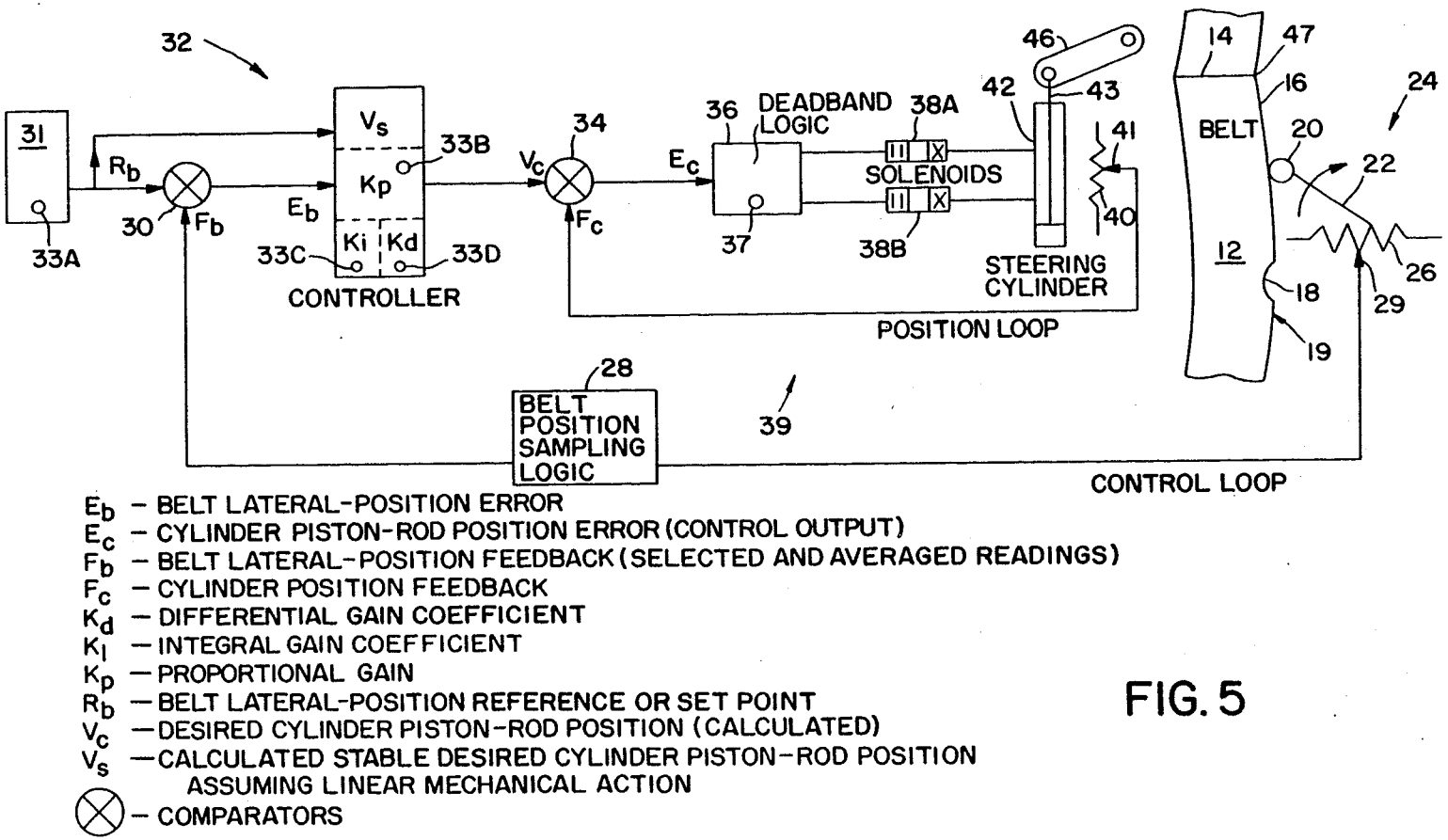
FIG. 5 shows a schematic diagram of a steering control circuit which can be employed to advantage in the illustrative presently preferred mode of putting the invention into practice.

A flexible metallic casting belt 12 with weld 14 and cambered edges 16 incorporates a cue notch 18 in one edge as shown in FIG. 2. We use a notch ¼ inch (6 mm) deep by 2 inches (51 mm) long, rounded as shown. Though smaller (or larger) notches appear suitable with appropriate sensing equipment, the size specified above reliably fulfills the functions described below. The rounded shape allows the notched area of the moving belt to pass without snagging a mechanically contacting edge-sensing roller 20 (FIGS. 4 and 5). This roller sensor is rotatably mounted on spring-loaded swinging arm 22 of an electrical sensing unit 24. The electrical sensing unit 24 is enclosed in a protective housing 25 and incorporates an electric position-sensor and signal transmitter, here shown as a conductive-plastic rotary potentiometer 26 in a strong, waterproof housing 25. This sensor-transmitter affords an output voltage corresponding to the lateral position of the moving belt edge, not merely a yes-or-no or yes-null-no signal as occurs in the prior art of which we are aware.

In twin-belt casters, the sensor unit 24 for each belt is normally placed on the inboard side of the machine. Only the sensor unit 24 for the upper casting belt is shown. The advantage of placing these sensors on the inboard side of the machine is that they do not impede belt replacement. They are placed near the entrance E (FIG. 4) so that they are located upstream from the exit so that the action of the exit pulleys (not shown in FIG. 4) performing belt steering does not immediately or detrimentally affect the signals from the sensing means 26. Moreover, in the upstream position as shown, the environment for each sensor unit 24 is more nearly free from cascading coolant. They are generally placed adjacent to the return reach of belt. An arrow 27 indicates the return travel of each revolving casting belt 12, returning toward the entrance pulleys 10.

The rounded cue notch 18 in the moving belt edge 16 is an example of a fixed cue signal source. That is, the passage of this cue notch past the sensor 24 initiates (cues) belt position sampling for the current revolution of the belt.

Alternatively, the sensor unit 24 may be replaced by a photo-optical device to sense the belt edge according to the variations or patterns of a light beam passing by and being variably partially obscured by the moving belt edge, thereby producing corresponding variations in an output voltage from the photo-optical sensor. Air sensing devices, responding to the variable interruption of one or more free air streams, may also be used in lieu of the sensor units 24.

Either a photo-optical sensor or an air sensor will work with a cue notch 18 of any of several shapes, not just a rounded shape. Again a cue signal source 18 could consist of a hole in the belt, sensed by photo-optical sensor or air sensor as just described. A cue signal source 18 can also be provided by some intentional alteration in the appearance or physical characteristics of the belt at the cue signal source point. For instance, with a visual cue signal source, a photoelectric cell can cue (initiate) the steering sequence. A spot of insulative coating of non-conductive material on an otherwise conductive belt margin can cooperate with one or more electric brushes or sliding contacts, or a spot of electrically conductive material over a non-conductive belt margin, can serve as the cue signal source. Similarly, a spot of magnetic coating on a non-magnetic belt could serve as the cue device, as can a spot of radioactive material on a belt in cooperation with a stationary receiver for the radioactive rays. None of these latter cue signal sources would involve any notch.

The advantages of the cue notch 18 are that it is simple and rugged while enabling use of the same sensor unit 24 that senses the belt lateral position. The location of cue notch 18 or a cue hole can be anywhere where neither molten metal nor water normally come into contact with the belt. Other kinds of cue signal sources as described have more freedom of location. Visual cue signal sources might conceivably be placed anywhere on the surface of the belt.

The cue notch 18 itself can be made the measuring place for steering control sensing if desired. We prefer to sense the average position of a small length 19 along the almost immediately adjacent unmodified edge 16 directly behind the cue signal source 18, for example a place 19 that passes the belt sensor soon after the cue notch has passed. For instance, the place 19 follows by 500 milliseconds the cue signal that indicates the passing of the notch. This one-half-second time interval is compatible with a typical speed of casting, which may be 25 feet (8 meters) per minute. Thus, 500 milliseconds corresponds to a distance of about 2.5 inches (about 63 millimeters), which is only a small remove in the present context.

Alternatively, the reference place 19, the place on the belt where the belt edge is sensed, could be located at some distance in time and place behind the cue notch 18. However, it is simpler to have the place 19 close to the notch, because sensing at a significant distance behind the cue 18 would necessitate a circuit geared to measuring the actual distance traveled since the cue notch had passed, rather than to the time elapsed. Elapsed time and distance traveled are not the same, not even at a given installation since, during casting or between casts, belt speeds may be changed at the discretion of the operator due to metal casting conditions. However, a measuring plane near to the notch can be repetitively identified approximately enough for present purposes with a time-delay circuit involving only a brief delay, for example not more than about 3 seconds, in preference to a more complicated distance-measuring circuit. This place 19 is the "tracking-error-sensing region" on the belt. The delay in reaching the place 19 can be in a range up to a maximum of about 15 inches from the cue notch 18, since the chamber of belts is a gradual and one-way phenomenon, not normally occurring abruptly or reversing along the length of a belt. If this broad tolerance is used, the cue notch should be placed far from the belt weld 14, since the joining of cambered cut ends of sheet stock results in a sudden change of direction 47 at the weld (FIG. 5).

Figure 6:
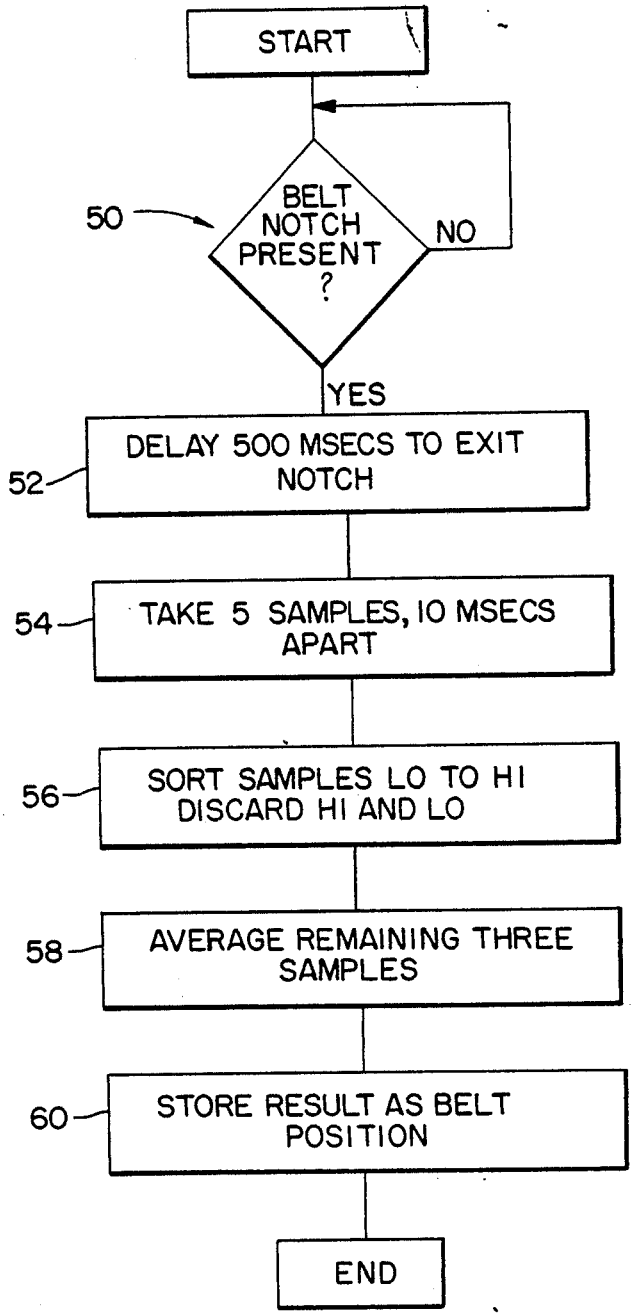
FIG. 6 is a flow chart illustrating the processing and algorithm utilized in determining and controlling the steering action in accord with the present invention.

Referring now to FIG. 5, a closed-loop control system is shown as being employed. The roller 20 on the swinging sensor arm 22 continuously adjusts a movable contact 29 of a potentiometer 26, which is suitably energized by a low-voltage direct current (DC) electrical source, such as a battery or DC power supply (not shown). The signal from the potentiometer contact 29 goes to a sampling circuit 28 labeled BELT POSITION SAMPLING LOGIC. The initial cueing signal delivered by the cue notch 18 in the belt edge at each belt revolution signal is represented at 50 in the sampling and control algorithm shown in FIG. 6 by the "Yes" and "No," standing for "Yes, a cue signal shows that the cue notch is present," or "No, the absence of a cue signal shows that the cue notch is not present." The presence of this cue signal is advantageously used as a zero reference for timing. A 500-millisecond delay is then provided as indicated at 52 to allow the position roller 20 to clear the cue notch 18 and to reach the predetermined sampling area 19 which is the tracking-error-sensing region on the belt. Next, as shown at 54, the sampling circuit 28 repetitively queries the potentiometer 26 for obtaining five belt-position readings in close succession, about ten milliseconds apart, though the selection of this interval is not at all critical and can be selected from a range up to about a fourth as wide as the aforesaid maximum delay range of about 3 seconds in starting the sampling.

The sampling circuit 28 now ranks the five sample readings from low to high, as indicated at 56, and the highest and lowest readings are discarded as being possibly the results of vagaries due to nicks, bits of dirt, or static. Next, as shown by the functional block 58, the remaining three of the five readings are averaged for providing a reliable reading (a reliable indication) of the now existing actual belt tracking position. This measured position value is stored in the sampling circuit 28, as indicated at 60 in FIG. 6, and remains stored for the remainder of the belt revolution. This measured position value (which may be considered as the data signal for indicating any error in belt position) is also sent as a signal $F_b$ to another comparator 30, as shown by the arrow and legend $E_b$. In the control circuit 30, the measured value $F_b$ for the present belt tracking position is compared with a reference signal $R_b$ which is provided from a potentiometer 31 having a manually adjustable control knob 33A that is used by the operator to set the desired belt tracking position for operation of the casting machine 9.

By comparing the measured value signal $F_b$ with the reference value signal $R_b$, the control-loop comparator 30 generates a difference signal $E_b$ which represents the now existing error in the actual measured position of the revolving belt 12. This error signal $E_b$ is fed into and is amplified by a proportional gain amplifier 32 labeled CONTROLLER. The magnitude of the now-existing-error signal $E_b$ is directly proportional to the gain $K_p$ of the amplifier 32. The output signal from the controller 32 has a value $V_c$ and represents roughly the error signal $E_b$ proportionally amplified by the proportional gain factor $K_p$.

This proportionally amplified signal $V_c$ may also be considered to be a steering reference (or steering control input) signal. It is fed to the feedback-position-loop comparator 34 for the purpose of controlling a linear steering cylinder 42 having a piston rod 43. For example, this linear steering cylinder 42 corresponds with the linear steering cylinder shown at 72 in FIGS. 8, 9, and 10 of U.S. Pat. No. 4,901,785 incorporated herein by reference. The cylinder piston rod 43 shown in FIG. 5 hereof, for example, corresponds with the piston rod 74 shown in FIGS. 8 and 9 of said copending patent application. Thus, movement of the cylinder piston rod 43 in FIG. 5, turning the lever 46, serves to steer a revolving casting belt 12 (FIGS. 1 and 4).

In order to close a feedback-position-control loop 39 for the cylinder 42 (FIG. 5), the linear belt-steering cylinder is equipped with a potentiometer 40 having a movable contact 41. This potentiometer 40 is electrically energized in a manner as described for the other potentiometer 26. Advantageously, this potentiometer 40 is, for example, a conductive plastic potentiometer located inside of the housing of linear cylinder 42 and having its movable contact 41 moved in unison with the travel of the steering cylinder piston rod 43. Thus, the movable contact 41 is being positioned at all times in accordance with the position of the piston rod 43, and thereby this movable contact 43 provides a feedback signal voltage $E_c$ that is linearly proportional to the position of the steering cylinder rod 43.

The belt-steering controller 34 compares the feedback signal $F_c$ (which represents the now-existing position of the steering piston rod 43) with the steering controller input signal $V_c$, and this controller 34 provides a steering control output voltage $E_c$ which is fed to a final electrical processor 36 labeled DEADBAND LOGIC, which finally activates hydraulic solenoid valves 38A and 38B to move cylinder 42 to the calculated position $V_c$.

The overall control operation or algorithm of the belt-steering controller 34 plus amplifier 32 is based on classical PID (proportional integral-differential) concepts as set forth in Equation (1) below, with one important modification, which will be explained later. The classic PID Equation is as follows:

$$V_c = V_s + K_p E_b + K_i \int E_b dt + K_d dE_b/dt \quad (1)$$

where $V_c$=controller output; calculated cylinder-position, fed to the cylinder feedback-position-loop comparator 34.

$V_s$=theoretically desired offset—i.e., where the piston rod 43 should be when the system reaches a stable, error-free condition and assuming that there be a linear relationship between the now-existing piston rod position and the now-existing belt position.

$E_b$=belt-position error signal from control-loop comparator 30.

$K_i$=integral gain of the controller 32.

$K_d$=derivative gain of the controller 32.

$K_p$=proportional gain of the controller 32.

In order to provide the two components of the output voltage $V_c$ in Equation (1) represented by the integral term $K_i \int E_b$ dt and by the differential term $K_d \cdot dE_b/dt$, the controller 32 has data storage capability for remembering previous values of $E_b$ which have recently been fed into this controller. Thus, this controller 32 determines the integral value of $E_b$ dt as well as the differential value $dE_b/dt$ which indicates the now-existing time rate of change of the error voltage signal $E_b$. In accord with usual PID controller practice, the controller 32 has manual knobs or other controls 33B, 33C, and 33D for adjusting the desired values for the overall proportional gain $K_d$, the integral coefficient $K_i$ and the differential coefficient $K_d$, depending upon the overall operational characteristics of the whole steering control system 45 shown in FIGS. 4, 5, and 6. $K_p$, $K_i$, and $K_d$ are adjusted at setup by trial and error by the aforesaid knobs or other controls. Too low a $K_p$ results in sluggish response; too high a $K_p$ results in overshoot and consequent hunting.

In response to the control signal $V_c$, the final processor/controller 36 supplies electrical power to actuate a pair of solenoid operated valves 38A and 38B which are connected to the linear steering cylinder 42 for feeding hydraulic liquid thereto for controlling the piston rod position. If the control signal $V_c$ is negative, the solenoid valves 38A and 38B are operated in a relationship for retracting the piston rod 43. If the control signal $V_c$ is positive, these solenoid valves are operated in the opposite relationship for extending the piston rod 43. Moreover, the amount by which this piston rod is retracted or extended is a direct function of the magnitude of the steering control signal $V_c$.

In order to prevent the solenoid valves 38S and 38B from repeatedly cycling on and off, the DEADBAND LOGIC controller 36 provides a physical tolerance zone. This controller 36 is programmed not to actuate the solenoid valves 38A and 38B unless and until the control signal $V_c$ exceeds a modest predetermined threshold value. This threshold value is manually adjustable, and the controller 36 includes a control 37 by which the operator can adjust the setting of this modest tolerance threshold for minimizing unduly repetitive cycling of these solenoid valves while also obtaining the desired precision in belt steering which is afforded by the control system 45.

In operation, if no belt lateral position error signal E exists, the last three terms (the "PID terms") in the Equation (1) drop out, leaving only the $V_s$ offset term which ideally would correspond to some one position $F_c$ of the steering lever 46 (FIG. 5) such as its halfway position, resulting in the belt 12 being stably centered on its pulleys 10. Under this ideal condition, $F_c = R_b$, or 50%=50%. That is, the piston rod position=the electrical dialed-belt-position reference $R_b$, both being at the halfway position. In actual practice, our steering mechanics are only roughly linear; thus the lateral position error (measured as $E_b$) of the revolving casting belt 12 may not always be reduced to zero by the standard PID logic. The integral term $K_i \int E_b$ dt is arranged not to cumulate indefinitely and so may not be sufficient to cause continuous striving for zero error. That is, $V_c$ may settle on a certain positive value while $F_c$ settles on an offsetting negative value or vice versa, resulting in null command $E_c$ to the solenoids 38A and 38B despite the need for an effective small command. As a result, extended periods of time could occur when an adjustment to the control output signal $E_c$ is needed but is not made—i.e., the command signal $E_c$ (FIG. 5) erroneously stays at zero.

Our algorithm recognizes these periods wherein small adjustment signals may be needed in $V_c$ but are not occurring. Our algorithm manipulates the $V_s$ offset term (which is the theoretically desired position of the piston rod) to the value $V_s'$, so as to require a corrected control output signal $V_c$. Our algorithm adjusts for the (in practice) non-linear relationship between the position $F_c$ of the piston rod 43 and the belt lateral position as indicated by the feedback signal $F_b$. At these times, $V_s$ is then to be modified to $V_s'$ through algebraic operations with two adjustable terms to compensate for mechanical non-linearity. If the lateral position error of the belt edge (measured as $E_b$) is less than 15 mils (0.4 mm) in either direction, no $V_s'$ modification is to be made, since a persistent error within this range is quite acceptable, whereas attempting to correct it could lead to oscillations. If error $E_b$ is greater than 15 mils and this error remains constant for two revolutions, then $V_s$ is to be manipulated to the modified value $V_s'$ according to the formula $$V_s' = R_b(1 \pm 0.005G \times H) \quad (2)$$

where $R_b$ is the lateral-belt-position set point. G is set to an integer between 1 and 10 by trial and error at setup, using an adjustment not shown, and then left alone. The additional factor H is made to vary according to the magnitude of the error $E_b$. If the error $E_b$ persists between 15 and 30 mils (0.4 to 0.8 mm), then H is set at 1, using an adjustment not shown. If the error persists between 30 and 90 mils (0.8 mm to 2.3 mm), H is set at 2. If the persisting error is greater than 90 mils (2.3 mm), H is set at 3. The minus sign in the ± sign in formula (2) is applied for persistent errors $E_b$ occurring in one direction of belt lateral tracking, while the plus sign is applied for such errors occurring in the opposite direction.

In the prior art known to us, expensive and complicated "servo valve" systems were required to achieve positional accuracy. Solenoid-valve systems with electronics such as in the present system are simpler and perform more than adequately, given that the dynamic operation of the belt steering mechanism does not require extremely rapid corrective actions.

RESULTS

The end results of employing the above-described method and system embodying the present invention is that the belts 12 are steered in such a way as to obtain speedy correction of belt tracking position while minimizing hunting action of the steering mechanism 38A, 38B, 42, 43. Observed tracking errors are cut by a factor of around 6, as compared with the best prior art of which we are aware. Formerly, steered revolving belts wandered regularly in the range of ±0.062 of an inch (±1.6 mm). Indeed, we observed three times that amount of belt excursions in one installation. Whereas, with this embodiment of the present invention, the maximum range of lateral belt excursion which was observed in one all-day experimental test was ±0.010 of an inch. The attendant advantages discussed above are also realized.

Although the examples and observations stated herein have been the results of experimental work with only a limited number of molten metals and their alloys, we believe that this invention appears to be applicable for steering revolving casting belts in the continuous casting of any metal.

Although specific presently preferred embodiments of the invention have been disclosed herein in detail, it is to be understood that these examples of the invention have been described for purposes of illustration. This disclosure is not to be construed as limiting the scope of the invention, since the described methods and systems may be changed in details by those skilled in the art of steering metallic casting belts, in order to adapt the apparatus and methods to be useful in particular casting machines or situations, without departing from the scope of the following claims.

We claim:

1. The method of steering a revolving endless flexible metallic casting belt of a continuous metal-casting machine, said machine including a steering sensor and mechanism that directly controls the lateral direction of belt tracking, the method including the steps of applying a cue device to said casting belt, by means of said steering sensor, sensing the lateral position of the belt edge in response to the passage of said cue device past a stationary sensing device, signaling information of said position to an information processing device which excludes signals originating from other areas of the belt, with the final step of employing the output of said information processing device to steer said casting belt by means of said mechanism that directly controls the lateral direction of belt tracking.

2. The method of steering side-to-side tracking of a revolving endless flexible metallic casting belt in a continuous metal-casting machine, comprising the steps of:

providing a cue signal source at a fixed position on the belt, sensing the cue signal source at a predetermined station in the metal-casting machine as the cue signal source passes said station during each revolution of the revolving casting belt, determining the tracking position of the belt in timed relationship following sensing of said cue signal source at said station, and steering the tracking of the revolving casting belt as a predetermined function of said determining of the tracking position.

3. The method as claimed in claim 2, in which:

said timed relationship involves a brief time delay following sensing of said cue signal source at said station and prior to determining the tracking position of the belt.

4. The method as claimed in claim 2, comprising the further steps of:

determining the tracking position of the belt by taking a multiplicity of measured samples of belt position, said multiplicity of measured samples being taken at closely spaced time intervals following sensing of said cue signal source, and averaging a plurality of said measured samples after discarding those measured samples of said multiplicity having more extreme values than the plurality which are averaged.

5. The method as claimed in claim 4, in which:

said timed relationship involves a brief time delay following sensing of said cue signal source at said station and prior to taking said multiplicity of measured samples of belt position.

6. The method as claimed in claim 5, in which:

said measured samples of belt position comprising said multiplicity are taken at uniformly spaced time intervals.

7. The method as claimed in claim 5, in which:

said brief time delay is no more than about 3 seconds.

8. The method as claimed in claim 5, in which:

said brief time delay is no more than about about 3 seconds, and said measured samples are taken at spaced time intervals of no more than about 500 milliseconds each, following said delay of no more than about 3 seconds.

9. The system for steering a revolvable, endless, flexible casting belt while the belt is being revolved in a continuous metal-casting machine comprising:

a steering cue signal source in predetermined fixed position on the belt, sensing means mounted in the metal-casting machine in a fixed position relative to the belt as the belt is revolving, said sensing means being responsive to said steering cue signal source for providing a cueing signal each time that said steering cue signal source passes said sensing means, steering means in the metal-casting machine for steering side-to-side tracking of the belt as the belt is revolving, control means connected to said steering means for controlling said steering means, said control means being connected to said sensing means for receiving said cueing signal, said control means being initiated by said cueing signal for determining the lateral position of the belt during a brief time interval following initiation by said cueing signal, and said control means controlling said steering means as a result of determining the lateral position of the belt during said brief time interval following initiation by said cueing signal.

10. The system for steering a revolvable casting belt as claimed in claim 9, in which:

said steering cue signal source is a notch in an edge of the belt.

11. The system for steering a revolvable casting belt as claimed in claim 9, and wherein the metal-casting machine is a twin-belt metal-casting machine having an inboard side and having an entrance and wherein return reaches of two casting belts travel toward the entrance, characterized in that:

said sensing means are mounted in the inboard side of the machine near an edge of each of said two casting belts adjacent to the return reach of each of said two casting belts near the entrance of the machine, and said steering cue signal is on the edge of each belt and the inboard side of the machine.

12. The system for steering a revolvable casting belt as claimed in claim 11, in which:

said steering cue signal source is a notch in said edge of each belt at the inboard side of the machine.

13. The system for steering a revolvable casting belt as claimed in claim 9, in which:

said brief time interval is no more than about one second.

14. The system for steering a revolvable casting belt as claimed in claim 13, in which:

said brief time interval includes a delay of no more than about 2 seconds; and following said delay, said control means determines the lateral position of the belt by at least three measured samples of the belt position taken at closely spaced time intervals and by discarding the highest and lowest of said measured samples.

15. The system for steering a revolvable casting belt as claimed in claim 13, in which:

said control means determines the lateral position of the belt by at least four measured samples of the belt position taken at closely spaced time intervals following said cueing signal, said control means discards the highest and lowest of said measured samples, and said control means averages the remaining measured samples.

16. A revolvable endless flexible metallic casting belt for a continuous metal-casting machine, said belt having a cue notch in an edge.

17. A revolvable, thin, endless, flexible metallic casting belt for use in a twin-belt continuous casting machine, said casting belt being characterized by:

a steering cue signal source on the belt in a fixed position on the belt, and said steering cue signal source being adapted for cooperative interaction with steering means in the twin-belt casting machine for cueing the operation of the steering means as the casting belt is revolving in the twin-belt casting machine.

18. A revolvable, thin, endless, flexible, metallic casting belt as claimed in claim 17, in which:

said steering cue signal source comprises a cue notch in an edge of the belt.

19. A revolvable, thin, endless, flexible metallic casting belt as claimed in claim 18, in which:

said cue notch is about ¼ of an inch deep (about 5 mm to about 7 mm deep), and said cue notch extends for a distance of about 2 inches (about 50 mm to about 52 mm) along said edge of the belt.

* * * * *